US006443802B1

(12) United States Patent
Vakili

(10) Patent No.: US 6,443,802 B1
(45) Date of Patent: Sep. 3, 2002

(54) MULTINATIONAL DOLL WITH CHANGEABLE FACES

(76) Inventor: Mahvash Vakili, 493 Purisima Ave., Sunnyvale, CA (US) 94086

( * ) Notice: Subject to any disclaimer, the term of this patent is extended or adjusted under 35 U.S.C. 154(b) by 0 days.

(21) Appl. No.: 09/610,707

(22) Filed: Jul. 7, 2000

(51) Int. Cl.[7] ..... A63H 3/12
(52) U.S. Cl. ..... 446/321; 446/390; 446/368
(58) Field of Search ..... 446/321, 99, 376, 446/394, 337, 97, 390, 100

(56) References Cited

U.S. PATENT DOCUMENTS

| | | | | | |
|---|---|---|---|---|---|
| ,243,752 | A | * | 7/1881 | Bartenstein | 446/321 |
| 1,138,412 | A | * | 5/1915 | Radick | 446/321 |
| 1,289,715 | A | | 12/1918 | Fellom | |
| 1,387,224 | A | | 8/1921 | Ahler | |
| 1,396,766 | A | | 11/1921 | McClelland | |
| 1,555,644 | A | | 9/1925 | Duncan | |
| 1,586,247 | A | * | 5/1926 | Kollin | 446/394 |
| 1,610,724 | A | | 12/1926 | Wilson | |
| 1,618,772 | A | | 2/1927 | Merseburger | |
| 2,195,127 | A | | 3/1940 | Brucker | |
| 3,419,993 | A | * | 1/1969 | Rodgers | 446/100 |
| 3,791,068 | A | * | 2/1974 | Pietrowiak | 446/321 |
| 3,851,419 | A | | 12/1974 | Kaelin | |
| 3,903,640 | A | * | 9/1975 | Dunn | 446/394 |
| 4,030,240 | A | | 6/1977 | Port | |
| 4,136,483 | A | * | 1/1979 | Shackelford et al. | 446/321 |
| 4,336,665 | A | * | 6/1982 | Moreau | 446/321 |
| 4,373,292 | A | * | 2/1983 | Pelura | 446/321 |
| 4,921,459 | A | * | 5/1990 | Cook et al. | 446/321 |
| 5,480,337 | A | * | 1/1996 | Baker | 446/321 |
| 5,788,554 | A | * | 8/1998 | Goodwin et al. | 446/100 |
| 5,807,155 | A | * | 9/1998 | Divvleeon | 446/369 |

* cited by examiner

*Primary Examiner*—Jacob K. Ackun, Jr.
*Assistant Examiner*—Urszula M. Cegielnik
(74) *Attorney, Agent, or Firm*—John S. Heyman

(57) ABSTRACT

The present multinational doll is comprised of a rotatable head with a plurality of different faces. The head is attached to a torso about a vertical axis to enable different faces to be aligned with the front of the torso. Hair is attached to the top of the head. The loose hair is simply draped over either face to expose one face and cover the other, so that it can be easily used by a child. The left and right limbs are of different colors, and each limb is a single color all around. Different skin colors are thus visible on the limbs simultaneously from the front of the doll. Therefore, the doll conveys the idea of different races of people living together in harmony. Further, clothing worn on the doll is printed with the names of many different countries to literally indicate the multinational nature of the doll.

7 Claims, 5 Drawing Sheets

MULTINATIONAL DOLL WITH CHANGEABLE FACES

BACKGROUND OF THE INVENTION

1. Field of the Invention

This invention relates generally to dolls.

2. Prior Art

Dolls with changeable features are well known in the art for providing more fun to children. Many U.S. patents disclose a head with multiple faces. The head is rotatable within and independently of a head covering, such as hair or headgear, to expose different faces. Examples of such patents include 1,618,772 to Merseburger, 1,610,724 to Wilson, 1,555,644 to Duncan, 1,387,224 to Ahler, and 52,782 to Checkeni. The drawback of such an arrangement is that the gap between the head and head covering is so obvious that realism is compromised. Some of these heads require adjustments that are too difficult for a young child to manage.

A doll disclosed in U.S. Pat. No. 3,851,419 to Kaelin includes a dress which is flipped over a two-faced head to alternately expose one face and cover the other with a head covering. The hair is arranged around the faces to keep them both exposed. The operation of this doll may be very confusing to a child. Further, the head covering is not in fashion.

Another type of doll which is also well known in the art includes limbs with two colors to represent peoples of different races or different creatures. U.S. Pat. No. 1,289,715 to Fellom discloses a two-sided doll with a human side and an animal side. U.S. Pat. No. 1,396,766 to McClelland discloses a doll with two opposite bodies connected at the waist, wherein one body is white and the other is black. U.S. Pat. No. 2,195,127 to Brucker discloses a doll with two pairs of arms, wherein one pair is white and the other pair is dark. U.S. Pat. No. 4,030,240 to Port discloses a doll with doubled-ended limbs, wherein each limb is white at one end and dark at the other, and is rotatable to reveal different ends.

All prior art multinational dolls have left and right limbs that are simultaneously the same color when viewed from either side. They provide the choice of playing with a doll with white limbs, or a doll with darker limbs. The purpose is to economize by providing two or more selectable appearances in the same doll. They do not provide a sense that the doll is a conglomeration of different races. They show the different races as being separate, and thus do not promote racial harmony.

OBJECTIVES OF THE INVENTION

Accordingly, the objectives of the present multinational doll are to: provide a plurality of selectable faces; enable the faces to be easily changed by a child; have no gaps between the face and the hair for realism; represent a person who is a conglomeration of different races; and promote racial harmony.

Further objectives of the present invention will become apparent from a consideration of the drawings and ensuing description.

BRIEF SUMMARY OF THE INVENTION

The present multinational doll is comprised of a rotatable head with a plurality of different faces. The head is attached to a torso about a vertical axis to enable different faces to be aligned with the front of the torso. Hair is attached to the top of the head. The loose hair is simply draped over either face to expose one face and cover the other, so that it can be easily used by a child. The left and right limbs are of different colors, and each limb is a single color all around. Different skin colors are thus visible on the limbs simultaneously from the front of the doll. Therefore, the doll conveys the idea of different races of people living together in harmony. Further, clothing worn on the doll is printed with the names of many different countries to literally indicate the multinational nature of the doll.

Figure 1:
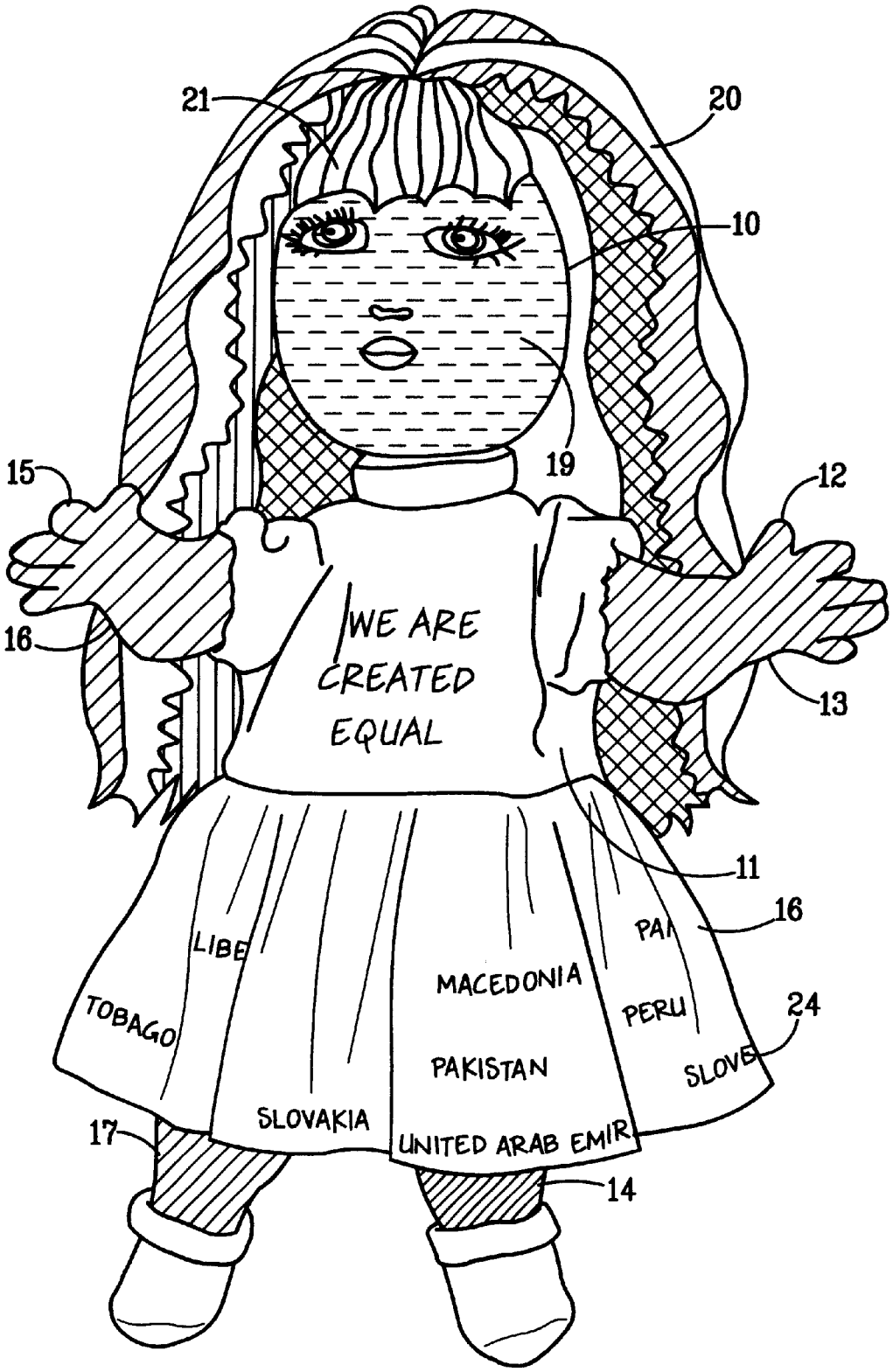
FIG. 1 is a front view of the present multinational doll.

| DRAWING REFERENCE NUMERALS | |
|---|---|
| 10. Head | 11. Torso |
| 12. Left Limbs | 13. Left Arm |
| 14. Left Leg | 15. Right Limbs |
| 16. Right Arm | 17. Right Leg |
| 18. Clothing | 19. First Face |
| 20. Hair | 21. Bangs |
| 22. Second Face | 23. Roots |
| 24. Names of Countries | |

DETAILED DESCRIPTION OF THE INVENTION

FIG. 1:

A preferred embodiment of the present multinational doll is shown in a front view in FIG. 1. It is comprised of a rotatable head 10, a torso 11, left limbs 12 comprising a left arm 13 and a left leg 14, and right limbs 15 comprising a right arm 16 and a right leg 17. Clothing 18 is worn over torso 11. The names 24 of many different countries are printed or otherwise arranged on clothing 18 to literally indicate the multinational nature of the doll. All the countries in the world are preferably represented, but just a few names are shown in the figure for simplicity. Other text or graphics may also be arranged on clothing 18, such as the slogan, "WE ARE CREATED EQUAL".

Head 10 is provided with a plurality of different faces on different sides, although only one is shown in FIG. 1. Head 10 is attached to torso 11 about a vertical axis and rotatable to align different faces with the front of torso 11. A first face 19 is shown positioned at the front. Hair 20 is attached to the top of head 10. In this example, bangs 21 are preferably provided on the side of first face 19. Alternatively, another hair style may be provided.

Figure 2:
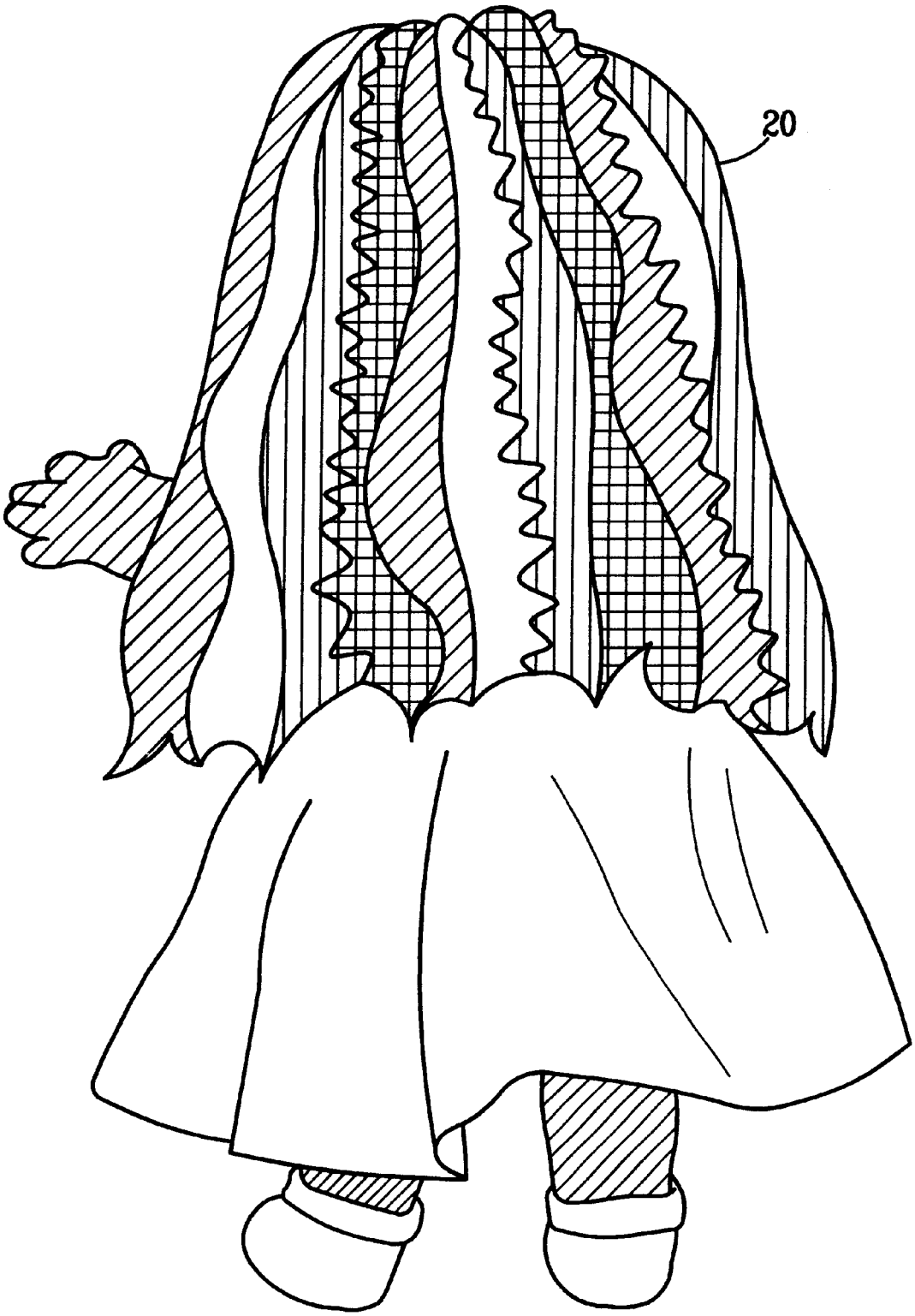
FIG. 2 is a rear view thereof.

FIG. 2:

As shown in a rear view in FIG. 2, the opposite side of the head is fully covered by hair 20 to obscure the opposite face.

Figure 3:
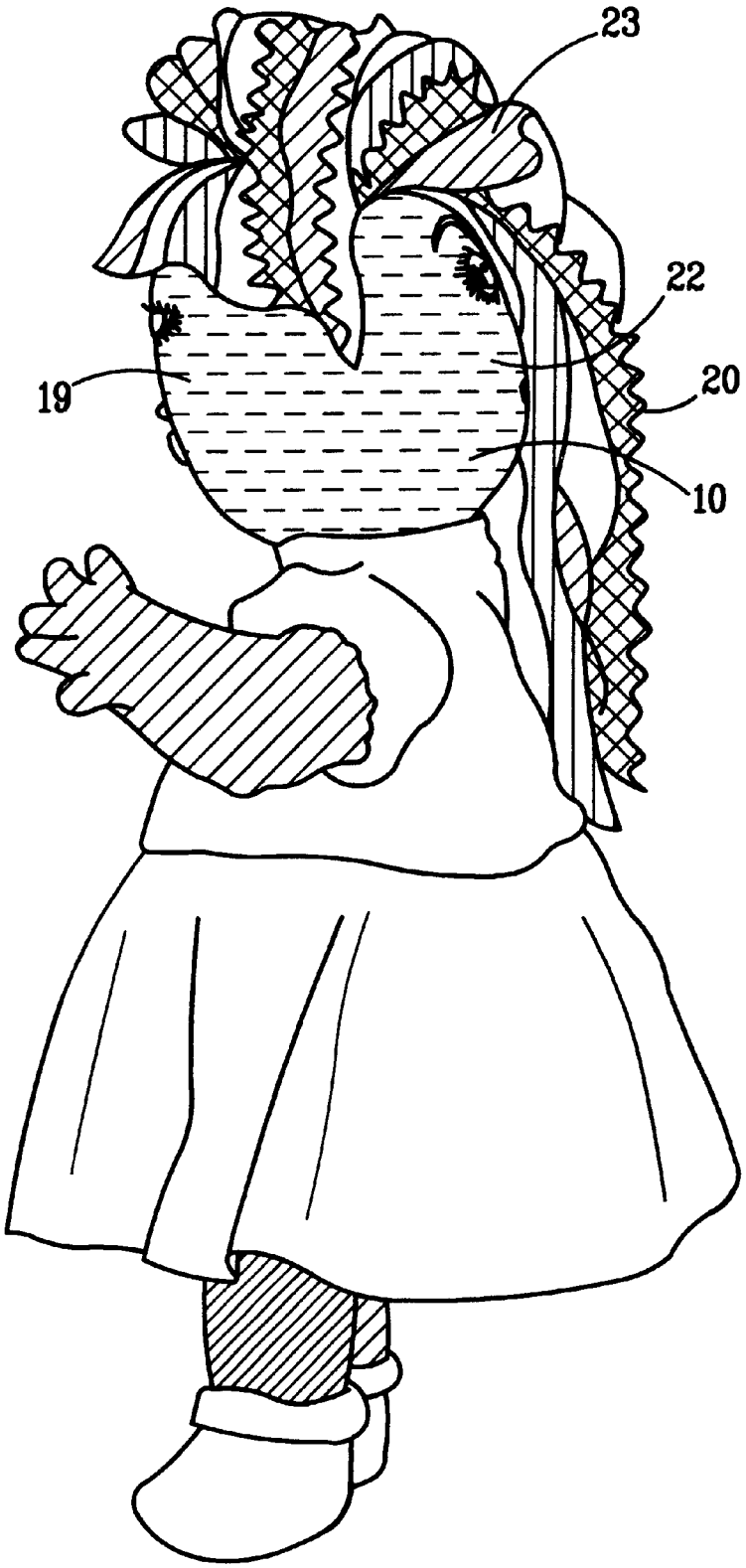
FIG. 3 is a side view thereof with its hair brushed to one side to reveal the multiple faces.

FIG. 3:

For illustration only, hair 20 is shown in FIG. 3 brushed to one side of head 10 to reveal first face 19 and a second face 22. Faces 19 and 22 preferably have different ethnic features. More faces may also be provided. Hair 20 is directly attached to head 10, preferably only at the top, and optionally at intermediate areas between faces 19 and 22.

Only roots 23 of hair 20 are attached to head 10. The rest of hair 20 is arranged to fall loosely around head 10. Hair 20 is simply draped over either face to alternately cover one face and expose the other, so that it can be easily used by a child. Unlike some prior art dolls, there is no gap between hair 20 and head 10 to mar the appearance of the doll. Different faces are thus selectable by rotating head 10 to align a desired face with the front of torso 11, and covering an unwanted face with hair 20.

Figure 4:
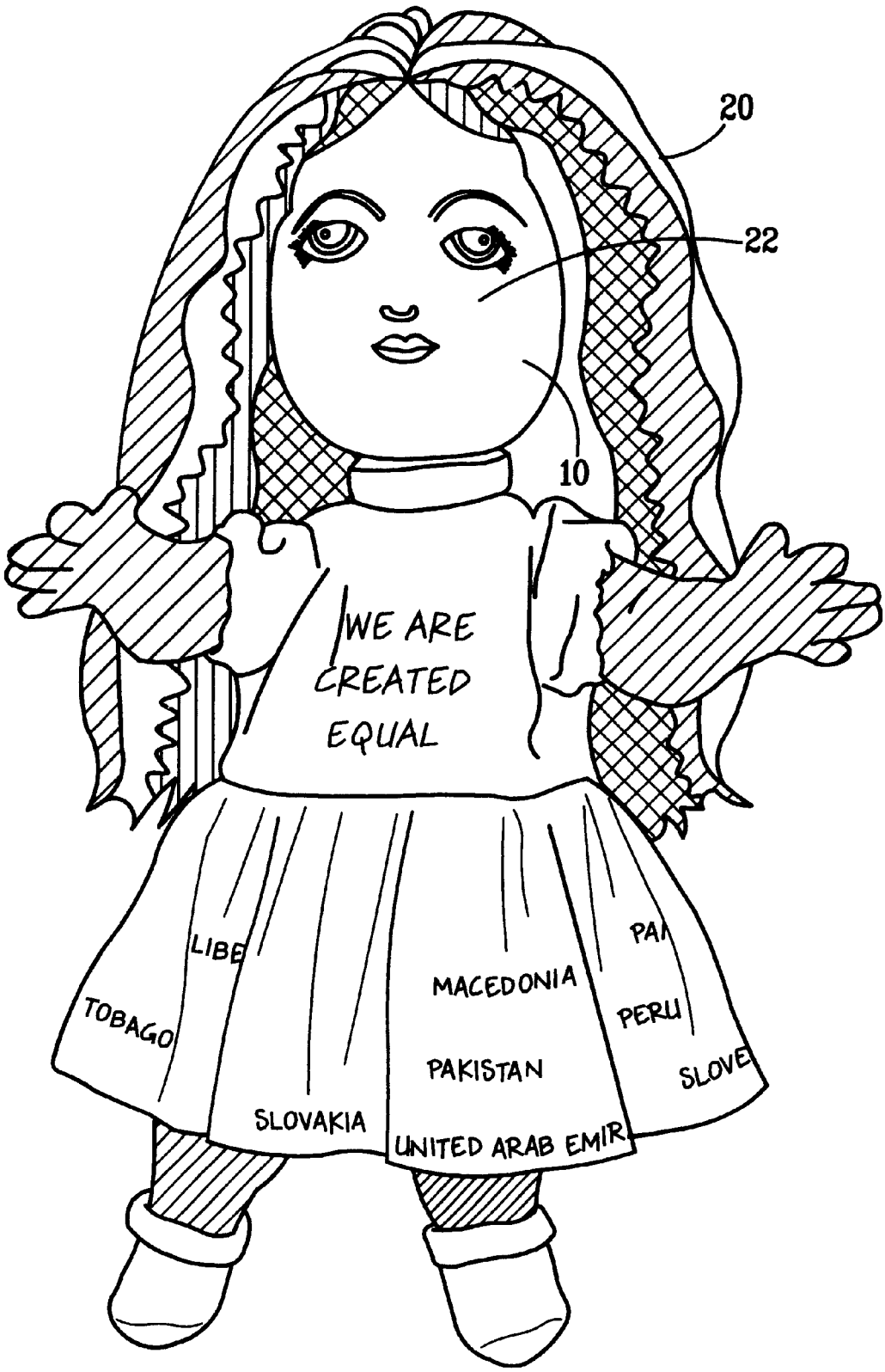
FIG. 4 is a front view thereof when a different face is revealed.
Figure 5:
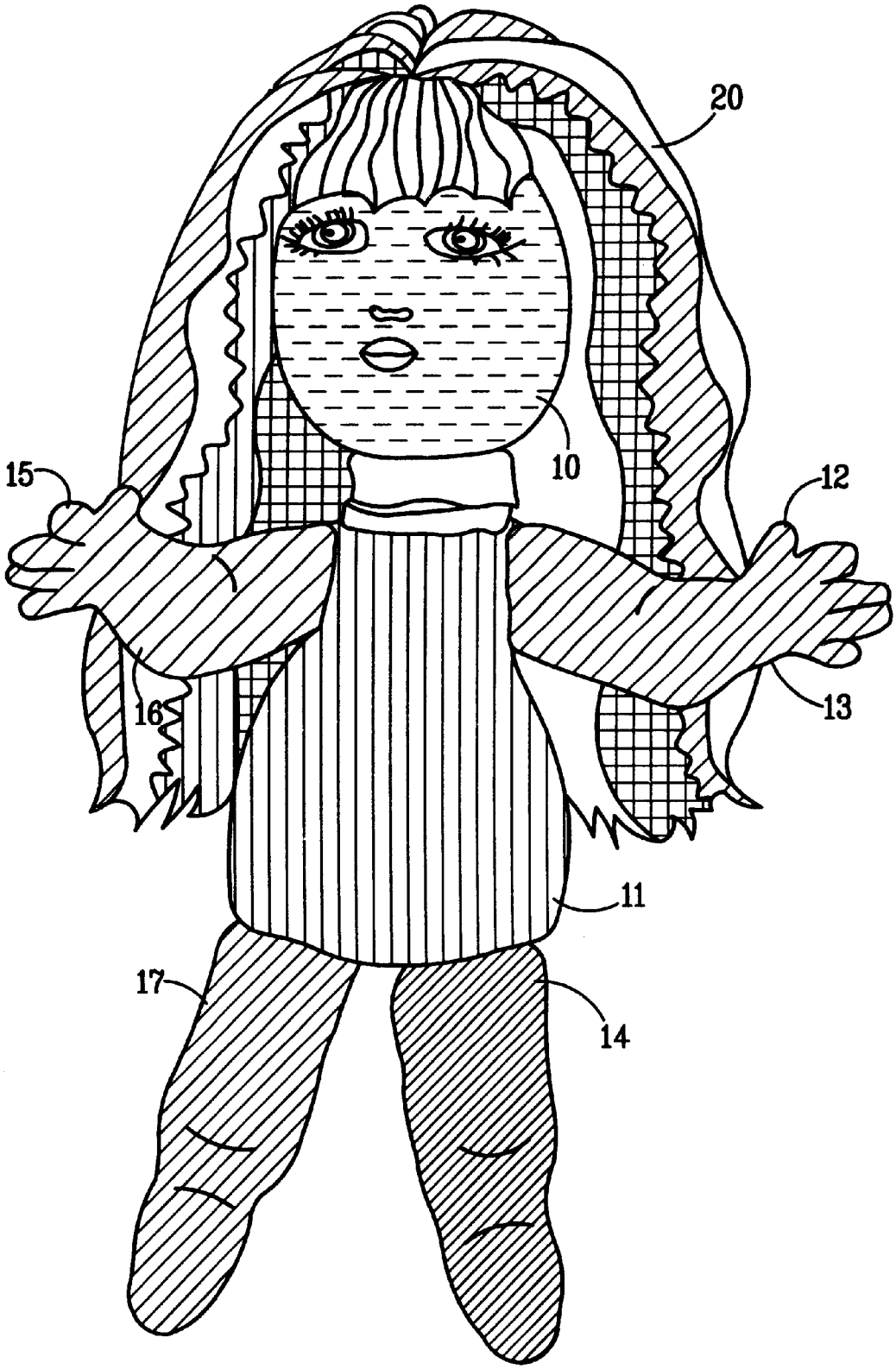
FIG. 5 is a front view thereof without clothing to show the colors of the torso and limbs.

FIG. 4:

In FIG. 4, head 10 is rotated to present second face 22 at the front of the doll. Hair 20 is draped over the other face at the back of the doll.

FIG. 5:

Left and right limbs 12 and 15 are preferably of different skin colors to represent different races of people. Torso 11 may also have a skin color which represents a particular race of people. Each limb is of a single color all around. Every limb is preferably of a different color, and no two limbs are of the same color, so as to represent as many races of people as possible. For example, head 10 may be light gray, right arm 16 may be light beige, left arm 13 may be a medium brown, right leg 17 may be dark brown, left leg 14 may be a dark beige, and torso 11 may be reddish brown. Other colors and color combinations may be provided, as long as each limb is a single color all around, and the limbs are comprised of at least two colors, so that a plurality of colors are simultaneously visible from the front of the doll. Hair 20 is preferably comprised of a mix of different types of hair, for example, black, blonde, red, and brown, each in straight and curly types for a total of eight different types of hair. Therefore, the doll conveys the idea of different races of people living together as one in harmony, and is a valuable education tool.

SUMMARY AND SCOPE

Accordingly, the present multinational doll provides a plurality of selectable faces. It enables the faces to be easily changed by a child. It has no gaps between the face and the hair. Therefore, the doll conveys the idea of different races of people living together in harmony. Accordingly, it promotes racial harmony.

Although the above description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A multinational doll having a conglomeration of different races represented in a single doll comprising:

a torso;

a head attached on top of said torso;

a plurality of limbs attached to said torso, wherein said limbs are comprised of a
right arm, a right leg, a left arm and a left leg;

wherein each limb is a different color from any other limb to represent different races of people, and wherein said skin color of any particular limb is consistent throughout, thereby a plurality of said skin colors are simultaneously visible from any angle to convey the idea of different races of people living together as one in harmony in a single doll.

2. The doll of claim 1 wherein said skin colors of said limbs include light beige, dark beige, medium brown, and dark brown representing respectively different races of people for these colors.

3. The doll of claim 1, wherein said torso is of a different skin color from said skin colors of said limbs to represent a further race of people.

4. A multinational doll having a conglomeration of different races represented in a single doll comprising:

a torso;

a head attached on top of said torso;

a plurality of limbs attached to said torso, wherein said limbs are comprised of a
right arm, a right leg, a left arm, and a left leg;

wherein each limb is a different color from any other limb to represent different races of people, and wherein said skin color of any particular limb is consistent throughout, thereby a plurality of said skin colors are simultaneously visible from any angle;

clothing worn over said torso; and a plurality of different country names arranged on said clothing to literally indicate a multinational nature of said doll and convey the idea of different races of people living together as one in harmony in a single doll.

5. The doll of claim 4, wherein said skin colors of said limbs include light beige, dark beige, medium brown, and dark brown representing respectively different races of people for these colors.

6. The doll of claim 4, wherein said torso is of a different skin color from said skin colors of said limbs to represent a further race of people.

7. The doll of claim 4, further including a slogan "WE ARE CREATED EQUAL" arranged on said clothing to further promote racial harmony.

* * * * *